US005882217A

United States Patent [19]

Aponte et al.

[11] Patent Number: 5,882,217

[45] Date of Patent: Mar. 16, 1999

[54] COAXIAL JACK WITH AN INTERNAL SWITCH MECHANISM

[75] Inventors: Luis A. Aponte, Andover; Mark Benda, Highland Lakes; Norris B. McLean, Englewood; Joseph P. Savicki, Clinton, all of N.J.

[73] Assignee: Lucent Technologies Inc., Murray Hill, N.J.

[21] Appl. No.: 948,456

[22] Filed: Oct. 10, 1997

[51] Int. Cl.[6] ..... H01R 29/00

[52] U.S. Cl. ..... 439/188; 439/944

[58] Field of Search ..... 439/188, 94.4; 200/51.1, 51.09

[56] References Cited

U.S. PATENT DOCUMENTS

| | | | |
|---|---|---|---|
| 4,749,968 | 6/1988 | Burroughs | 333/105 |
| 4,815,104 | 3/1989 | Williams et al. | 375/257 |
| 5,233,501 | 8/1993 | Allen et al. | 361/733 |
| 5,280,254 | 1/1994 | Hunter et al. | 439/188 |
| 5,348,491 | 9/1994 | Louwagie et al. | 439/188 |
| 5,482,469 | 1/1996 | Seiceanu et al. | 439/188 |

OTHER PUBLICATIONS

AMP Product Sheet—BNC Self–Terminating Connectors, Jun. 1994, p. 57.

*Primary Examiner*—Steven L. Stephan
*Assistant Examiner*—Hal Moon Hyeon

[57] ABSTRACT

A coaxial jack with an internal switch mechanism includes a cylindrical shell having an axial front opening, and an elongate center conductor supported coaxially inside the shell. A back end of an elongate resilient switch contact is fixed by a switch contact support at a back portion of the shell on one side of the shell axis. The switch contact extends inside the shell toward the front opening at a certain inclination and has a free end located on a side of the shell axis opposite the one side. The switch contact is configured and positioned to make an electrical connection with the center conductor in the absence of a mating plug. An elongate actuator is supported on the inner periphery of the shell and has an engaging part that protrudes into a defined plug travel path inside the shell. The engaging part is configured to cause the free end of the switch contact to deflect by an amount sufficient to break the electrical connection between the contact and the center conductor when a mating plug travels into the shell and displaces the engaging part of the actuator.

11 Claims, 6 Drawing Sheets

COAXIAL JACK WITH AN INTERNAL SWITCH MECHANISM

BACKGROUND OF THE INVENTION

1. Field of the Invention

The present invention relates to coaxial jack constructions, and particularly to a coaxial jack having an internal switch mechanism.

2. Discussion of the Known Art

Type 440 coaxial jacks, which are compatible with type 440 plugs, are known generally for use in telephone cross-connect systems. One such system, known as System III DSX-3/4, has been used in telecommunication networks in the United States for the past seven years. The system is used to cross-connect DS3, STS1, STS3 or DS4 level signals manually at a central office.

A building block of the System III DSX-3/4 is called a DSX-3/4 module. This module has a 3-inch by 3-inch by 0.5 inch die cast metal case. The case houses a jack set comprised of five conventional type 440 jacks, and three mechanical switches interposed externally between four of the jacks. The switches have activators and contacts that enter side openings in the jack barrels to sense an inserted plug. See, e.g., U.S. Pat. No. 4,815,104 (March 1989). The five type 440 jacks open on a front panel of the case, and two bulk head type BNC jacks are mounted on a rear panel of the case. Other components inside the case include two hand-soldered coaxial cables, a metal housing for the five type 440 jacks, three resisters, and one inductor. The module is also known as a 1201A jack set.

The internal component layout in the 1201A jack set is very difficult to modify. This makes additional features very difficult to provide, since only a limited number of coaxial cables can fit inside the jack set, and routing the cables requires extreme care to maintain consistent transmission performance. It would therefore be desirable to incorporate a printed wiring board in a 1201A jack set for mounting of all components and routing all signal lines. See U.S. Pat. No. 5,233,501 (August 1993)

Another cross-connect system, the DIXI-3, has been used in telecommunication networks in the United States for the past three years. The DIXI-3 system is used to interconnect and cross-connect DS3, STS1 and STS3 signals manually in a central office.

A building block of the DIXI-3 system is the DIXI-3module. This module has a 0.75-inch by 5.5-inch by 6.0-inch plastics case which houses a printed wiring board with eight right-angle BNC connectors. Because the DIXI-3 system is a rear-cabled rear cross-connected system, four BNC connectors are located at a rear end of each module and four BNC connectors are located at a front end of the module. The BNC connectors at the rear are for cabling and cross-connecting operations, and the BNC connectors at the front are for patching and monitoring. Migration from the earlier mentioned DSX-3 system with 440 jacks to a DIXI-3 system, would be simplified if the BNC jacks for patching and monitoring on the DIXI-3 modules are replaced by type 440 jacks. Thus, there is also a need for a type 440 coaxial jack that is right-angled with an internal switch, and which is easily mountable on printed wiring boards of the kind used in existing systems.

SUMMARY OF THE INVENTION

According to the invention, a coaxial jack with an internal switching mechanism comprises a cylindrical shell having an axial front opening and defining a plug travel path inside the shell for a mating plug. An elongate center conductor is supported coaxially inside the shell to connect to a corresponding conductor of the plug. A switch contact support is fixed at a back portion of the shell, and an elongate resilient first switch contact is fixed at a back end by the switch contact support, on one side of the shell axis. The first switch contact extends inside the shell toward the front opening with a determined inclination and has a free end positioned on a side of the shell axis opposite the one side. The first switch contact is configured and positioned to make an electrical connection with the center conductor in the absence of a mating plug in the shell.

An elongate actuator is supported on the inner periphery of the shell and has an engaging part that protrudes into the plug travel path. The engaging part is configured to cause the free end of the first switch contact to deflect by an amount sufficient to break the electrical connection between the contact and the center conductor, when a mating plug travels into the shell and displaces the engaging part of the actuator.

For a better understanding of the invention, reference is made to the following description taken in conjunction with the accompanying drawing, and the scope of the invention will be pointed out in the appended claims.

DETAILED DESCRIPTION OF THE INVENTION

Figure 1:
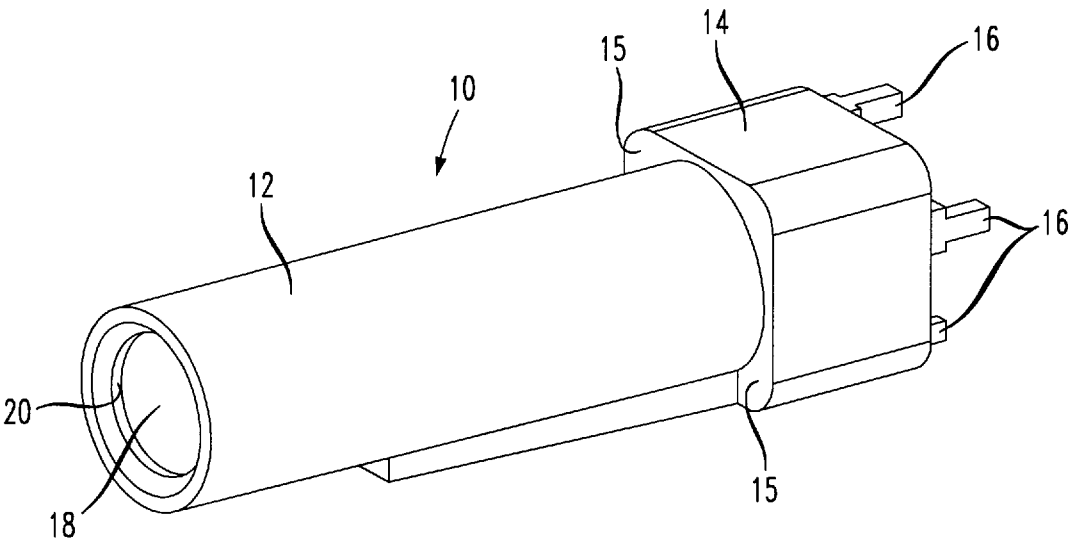
FIG. 1 is a perspective view of one embodiment of a coaxial jack according to the invention.

FIG. 1 is a perspective view showing the exterior of a coaxial jack 10 according to the invention. The jack 10 comprises an outer cylindrical barrel housing 12 made, for example, from a molded metalized plastics material or metal such as a zinc alloy to conduct a ground potential. A generally rectangular base portion 14 houses a jack switch contact support 40 (see FIGS. 2 & 3). The base portion 14 is preferably formed integrally with the cylindrical barrel housing 12, and forms ledges 15 that facilitate manual handling and mounting of the jack 10 when assembled into a jack module.

The jack base portion 14 in FIG. 1 also has a number (e.g., four) of compliant mounting pins or lugs 16 projecting axially from the bottom edge of the base portion in a defined pattern to engage corresponding mounting holes in a printed wiring board. The barrel housing 12 has a cylindrical, electrically conductive spring shell 18 supported coaxially along the inner periphery of the housing 12. The shell 18 and the housing 12 together define an axial front opening 20. The shell 18 also defines a path of travel when a mating coaxial plug (not shown) is inserted in the jack 10 through the front opening 20.

If applied for use as a type 440 jack, the front opening 20 of the barrel housing 12 has a diameter of typically 0.300 inches. The combined length of the barrel housing 12 and base portion 14, excluding the pin projections 16, is typically 1.870 inches. The length of the pin projections 16 is typically 0.165 inches. The base portion 14 of the jack 10 has, for example, a square cross-section measuring 0.490 inches on a side.

Figure 2:
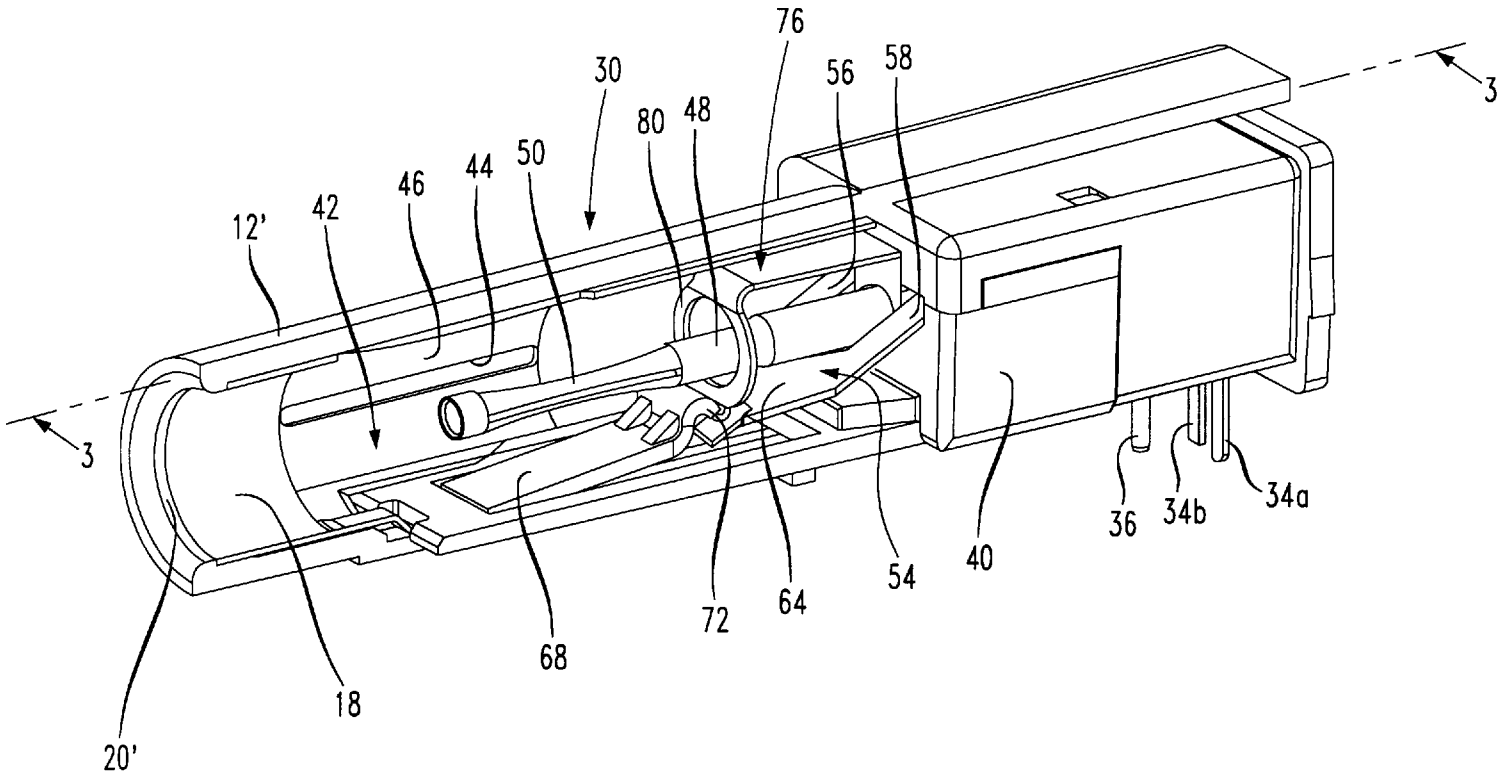
FIG. 2 is a perspective view of another embodiment of a coaxial jack according to the invention and showing an interior portion of the jack.
Figure 3:
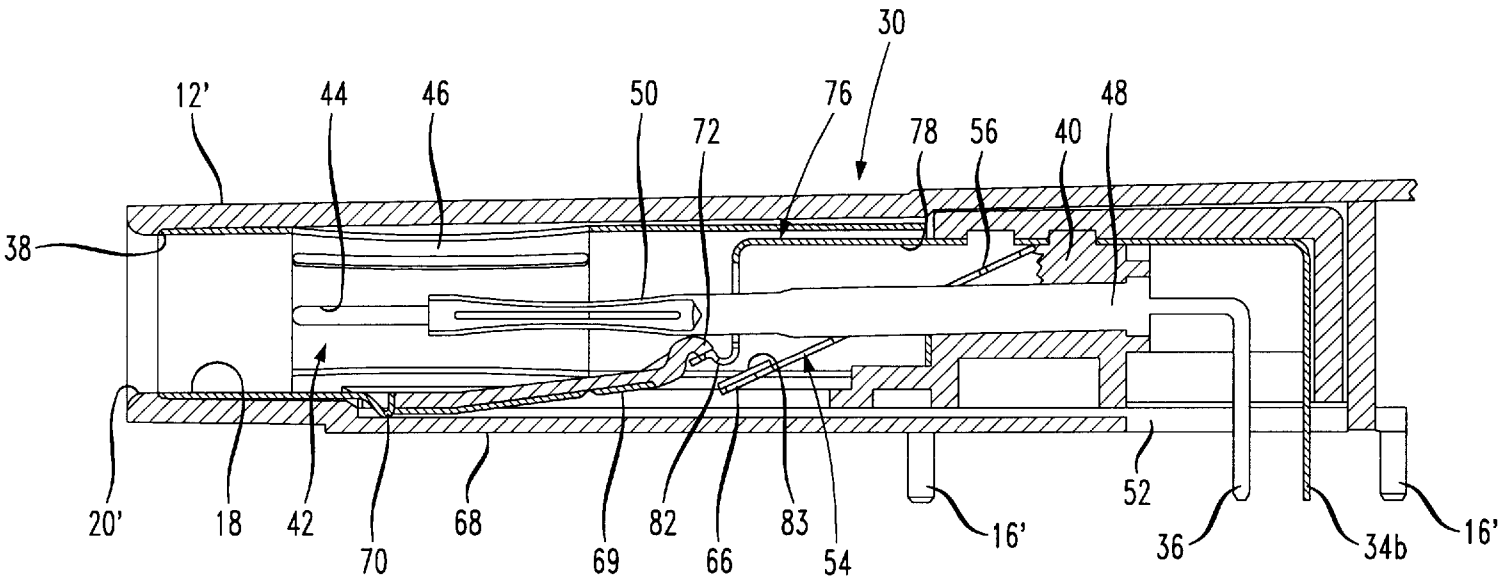
FIG. 3 is a sectional view of the jack in FIG. 2 taken along line 3—3.

The jack 10 in FIG. 1 has an internal switch mechanism which is described in detail with respect to the embodiment of FIGS. 2 and 3. Switch contact terminals and a terminal for a jack center conductor (not shown in FIG. 1) protrude axially in a determined pattern from the base portion 14 to engage corresponding terminal openings in a printed wiring board.

FIGS. 2 and 3 are views of a coaxial jack 30 according to the invention. The basic structure of the jack 30 differs from that of the jack 10 in FIG. 1 by the provision of right-angled jack mounting pins 16', switch contact terminals 34*a*, 34*b*, and jack center conductor terminal 36 for engaging corresponding openings in a printed wiring board. Parts of the jack 30 in FIGS. 2 and 3 that correspond to parts of the jack 10 in FIG. 1, have corresponding reference numerals.

The jack shell 18 fits snugly along the inner periphery of the barrel housing 12' and is locked against axial movement by an annular lip 38 that protrudes radially inward from the housing 12' at the jack front opening 20', and the switch contact support 40 fixed at a back portion of the shell 18 inside barrel housing 12'. A section 42 of the shell 18, near the jack front opening 20', has a number of axially extending slots 44 equi-circumferentially spaced from one another and forming a spring constriction 46 in the shell section 42. When a mating plug connector (not shown) is inserted in the front opening 20', the plug body slides against and is held frictionally in place by the spring constriction 46. An effective, sliding electrical (e.g., ground) contact is thus established between the shell 18 and the outside body of the plug connector.

An elongate center conductor 48 is supported coaxially inside the shell 18 by the switch contact support 40 or equivalent means fixed in the housing 12' at the back portion of the shell. The center conductor extends axially toward the front opening 20', and has a tubular front end 50 that is radially constricted. The front end 50 is dimensioned to receive and to engage fictionally a center pin of a mating plug connector, and to establish an electrical connection between the center conductor 48 and the plug center pin. The center conductor terminal 36 extends axially from the back of the center conductor, bends 90 degrees to pass through a clearance opening 52 in the housing 12', and projects radially a certain distance outside the housing.

A first switch contact 54 inside the jacks 10 and 30 is in the form of an elongate, generally "Y"-shaped resilient metallic strip. Arms 56, 58 of the contact 54 have back ends that are fixed by the switch contact support 40, at a side of the shell axis above the center conductor 48 as seen viewed in FIG. 2. The switch contact 54 extends from the contact support 40 through the shell 18 toward the front opening 20' with a determined inclination, for example, about 20 degrees with respect to the shell axis. The arms 56, 58 pass diametrically opposed sides of the center conductor 48 as seen in FIG. 2, but edges of the arms do not contact the center conductor.

Arms 56, 58 join at a fork 64 of the contact 54, and a free end 66 of the contact 54 is positioned on a side of the shell axis below the center conductor as viewed in FIG. 2. The fork 64 is so positioned and configured as to have an inner edge extending between the arms 56, 58 make electrical contact with the center conductor 48 in the absence of a mating plug in the shell. Preferably, the fork 64 exerts a certain preload contact force against the center conductor 48, for example, by making it necessary to urge the contact arms 56, 58 radially downward when assembling the jack to allow the center conductor 48 to slide between the arms, and over and against the inner edge of the fork 64. One of the arms (e.g., arm 58) continues to extend axially from the support 40 toward the back of the housing 12', turns at a right-angle to exit the clearance opening 52, and projects from the jack housing to form the switch contact terminal 34*a*.

An elongate actuator 68 is supported for pivotal movement on the inner periphery of the shell 18, on a spring leaf 69 formed in the shell section 42. The actuator 68 is located on the same side of the shell axis as the free end 66 of the first switch contact 54. Actuator 68 extends axially toward the back of the shell 18, and an engaging part 72 at the rear end of the actuator protrudes in the plug travel path inside the shell 18. The engaging part 72 is configured to cause the free end 66 of the first switch contact 54 to deflect by an amount sufficient to break the electrical connection between the contact 54 and the center conductor 48, when a plug inserted in the shell 18 displaces the engaging part 72. Prior to displacing the free end 66 of the first switch contact 54, the actuator 68 displaces a second switch contact 76 which is constructed and arranged as follows.

The second switch contact 76 has a generally "L"-shaped profile, wherein a long "leg" 78 of the contact has a back end fixed by the switch contact support 40, at the same (upper) side of the shell axis at which the back ends of the first switch contact arms 56, 58 are fixed by the support 40. The leg 78 extends inside the shell 18 substantially parallel to the shell axis, and bends at substantially a right angle to form an open ring 80 through which the center conductor 48 clearly passes out of contact with the ring 80. The ring 80 has a bottom contact hook 82 on the same side of the shell axis as the free end of first switch contact 54. The engaging part 72 of the actuator 68 rests on the hook 82 of the second switch contact 76. The hook 82 and a contact pad 83 on the free end 66 of the first switch contact 54, form a determined gap between one another as seen in FIG. 3. The leg 78 of the second switch contact 76 also extends axially toward the back of the housing 12', turns at a right-angle to exit the clearance opening 52, and projects from the jack housing to form the switch contact terminal 34*b*.

When constructed as described herein, the coaxial jacks 10, 30 have a fully internal switch mechanism, with external switch contact terminals and jack mounting pins. The jacks are thus suitable for mounting on a printed wiring board whether upright (jack 10), or flush with a right-angle orientation (jack 30) relative to the board. In the illustrated embodiments, the internal switch mechanism is such that in the absence of a mating plug in the jack, the first switch contact 54 is in electrical contacting relation with the center conductor 48, and the potential of the center conductor 48 is on the switch terminal 34*a*. When a plug is inserted in the jack, a leading end of the plug body displaces the engaging part 72 of the actuator 68 inside the shell 18, and causes the actuator 68 to deflect downwardly in FIGS. 2 & 3 to urge the hook 82 of the second switch contact 76 against the contact pad 83 on the free end 66 of the first switch contact 54.

The engaging part 72 protrudes in the travel path of an inserted plug to such a degree that when deflected by the plug, it urges the hook 82 of the second switch contact against the free end 66 of the first switch contact and continues to deflect the both of them enough to break the electrical connection between the first switch contact 54 and the center conductor 48. Thus, when a plug is inserted in the jack, the first switch contact 54 breaks its electrical connection with the center conductor 48 and makes an electrical connection with the second switch contact 76. The opening in the ring 80 of the second switch contact 76 is large enough so that the second switch contact does not make electrical contact with the center conductor 48 when the former is fully deflected by the actuator 68. Accordingly, with a plug inserted in the jack, the external jack switch terminals 34*a*, 34*b* are internally connected to one another via the switch contacts 54, 76; and the center conductor terminal 36 is internally disconnected from terminal 34*a*.

Use of the present coaxial jack construction as a type 440 jack in a modified 1201A jack set (see FIGS. 4 and 6) can realize as much as a 50 percent reduction in manufacturing costs over present 1201A jack sets. A modified 1201A jack set with the present jacks will allow the use of a plastics case which significantly reduces weight. Further, a 440 jack made according to the invention will facilitate the creation of an expanded DSX-3 product family.

The construction and arrangement of the first and the second switch contacts 54, 76 gives each of them a long moment arm between a point at which the actuator 68 transmits a force on the contact, and points at the back ends of the contacts where they are fixed by the support 40, in a relatively narrow cross-section inside the jack shell 18. The advantage of such a long moment arm is that it allows for a large contact deflection before contact yield, and, thus, better switch reliability. Further, the placement of the switch actuator 68 on a leaf part of the metallic spring shell 18 improves transmission performance and reduces the number of parts. The switch terminals and mounting pins of the present jack allow a press-fit or solder interface with a printed wiring board and a minimal, "tweak-free" hand assembly. Wiping action between the fork 64 of first switch contact 54 and center conductor 48, and between second switch contact 76 and the contact pad 83 on first switch contact 54, ensures a high level of reliability.

Figure 4:
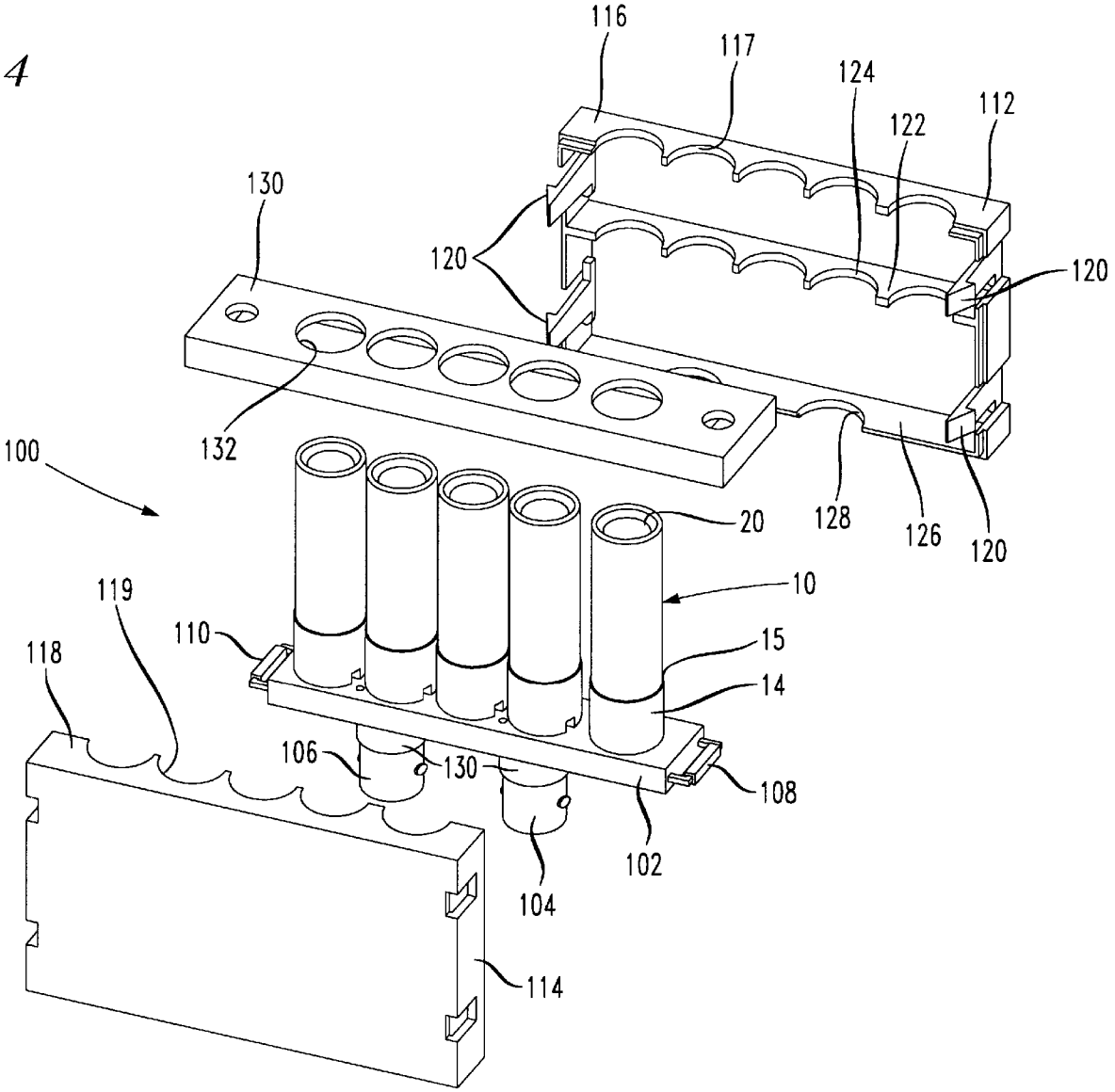
FIG. 4 is an assembly view of a connector module according to the invention.

FIG. 4 is an assembly view of a connector module 100 according to the invention. The module 100 corresponds to the mentioned 1201A jack set and may be substituted for that module in current System III DSX-3/4 telephone cross-connect systems.

The module 100 comprises an elongate, generally rectangular printed wiring board 102 on which printed wires (not shown) interconnect terminals of a pair of type BNC jacks 104, 106 mounted on a rear side of the board 102; and a set of five coaxial jacks 10 mounted on a front side of the board. External discrete components 108, 110 are mounted at axial ends of the board 102. The printed wiring board 102 with the coaxial connectors and components mounted thereon is fixed inside a half-casing 112 which, for example, is molded from a lightweight, plastics material.

Half-casing 112 and a mating half-casing 114, each have a front end wall 116, 118 with semi-circular cutouts 117, 119 that partly encircle front portions of the coaxial jacks 10 when the half-casings are snapped together via flexible locking tabs 120. The half-casings 112, 114 also have a transverse wall 122 with semi-circular cutouts 124. The walls 122 together encircle the circumference of coaxial jacks 10 at an axial position between the jack front openings 20 and their base portions 14 when the half-casings 112, 114 are joined to one another. The half-casings each have a back end wall 126 with two semi-circular cutouts 128 to encircle the BNC jacks 104, 106 when the half-casings are joined.

Preferably, the distance between the transverse wall 122 and the back end wall 126 of each half-casing corresponds to the axial distance between the ledges 15 on each of the jacks 10, and ledges 130 at base portions of the BNC jacks 104, 106. The printed wiring board 102 thus can be mounted between the transverse and back end walls 122, 126 of the half-casing 112 with the walls aligned flush against the ledges of the coaxial jacks. The mating half-casing 114 is then snapped over the jacks with its walls also flush on the ledges of the coaxial jacks. The printed wiring board 102 and the jacks mounted on the board are then secured inside the assembled half-casings without the need for additional mounting hardware. If desired, a shield 130 having circular openings 132 may be lowered over front portions of the jacks 10 protruding from the end front walls 116, 118 of the half-casings when assembled. The openings 132 have diameters sufficiently greater than the diameters of the jacks 10 to allow for variations in alignment of the jacks 10.

Figure 5:
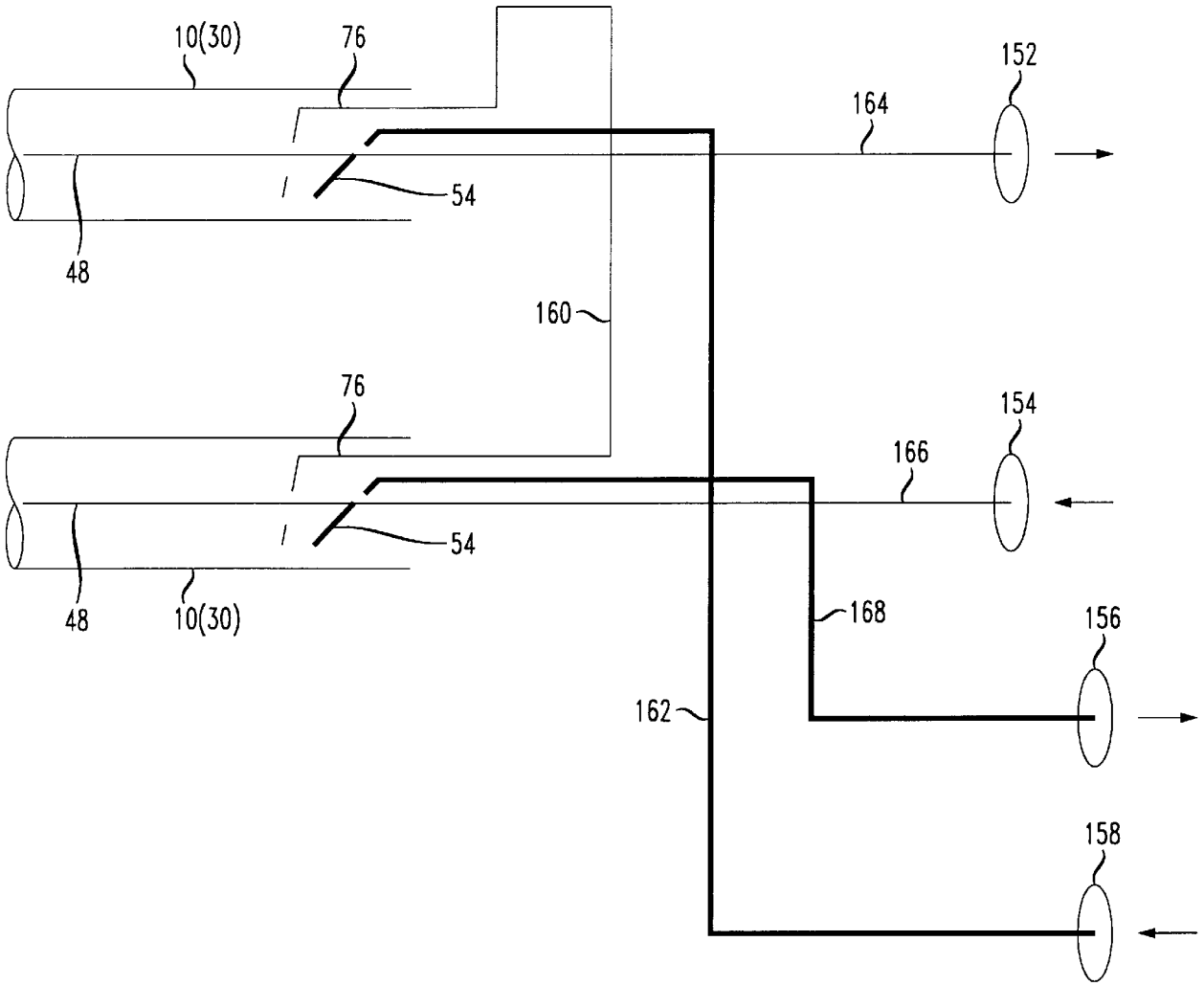
FIG. 5 is a circuit diagram showing coaxial jacks of the invention connected in a return loop switching configuration.

FIG. 5 is a circuit diagram showing a pair of the coaxial jacks 10 (or 30) in a "loop back" configuration with two other pairs of jack connectors 152, 154 and 156, 158. The connectors 152, 154, 156 and 158 may, for example, be conventional coaxial connectors mounted on a common case with the connectors 10, and with ground parts of all connectors properly connected with one another by the case or other appropriate means (not shown).

In FIG. 5, in the absence of plug connectors in the jacks 10, each of the first switch contacts 54 makes electrical connection with a corresponding center conductor 48, as shown. The second switch contacts 76 are connected to one another by an external or printed wire lead 160. A signal entering the jack 158 is conducted via lead 162 to the first switch contact 54 in the upper jack 10 in FIG. 5. The signal on lead 162 is thus connected to the center conductor 48 of the upper jack 10, and to lead 164 which connects the center conductor to the jack 152. Further, a signal entering the jack 154 is conducted via a lead 166 to the center conductor 48 of the lower jack 10 in FIG. 5, and, thus, to the first switch contact 54 which is in electrical connection with the center conductor. The signal is routed from the first switch contact 54 of the lower jack 10, to the jack 156 over lead 168. Accordingly, a duplex communication link is carried between the jack pair 152, 154 and the jack pair 156, 158 in the absence of patch cable plugs in the jacks 10.

When a pair of cable plugs are inserted in the jacks 10, the first switch contacts 54 inside the jacks 10 break their electrical connections with the center conductors 48, and connect instead with the second switch contacts 76. Because the second switch contacts 76 are connected together externally via the lead 160, a signal entering the jack 158 will now emerge from the jack 156 via leads 162, 160 and 168 in that order. That is, the jack 158 is looped back to the jack 156. Cables plugged into the jacks 152, 154 are connected only to corresponding center conductors 48 of the jacks 10, and a duplex communication link is defined between those cables and the patch cables plugged into the jacks 10.

Figure 6:
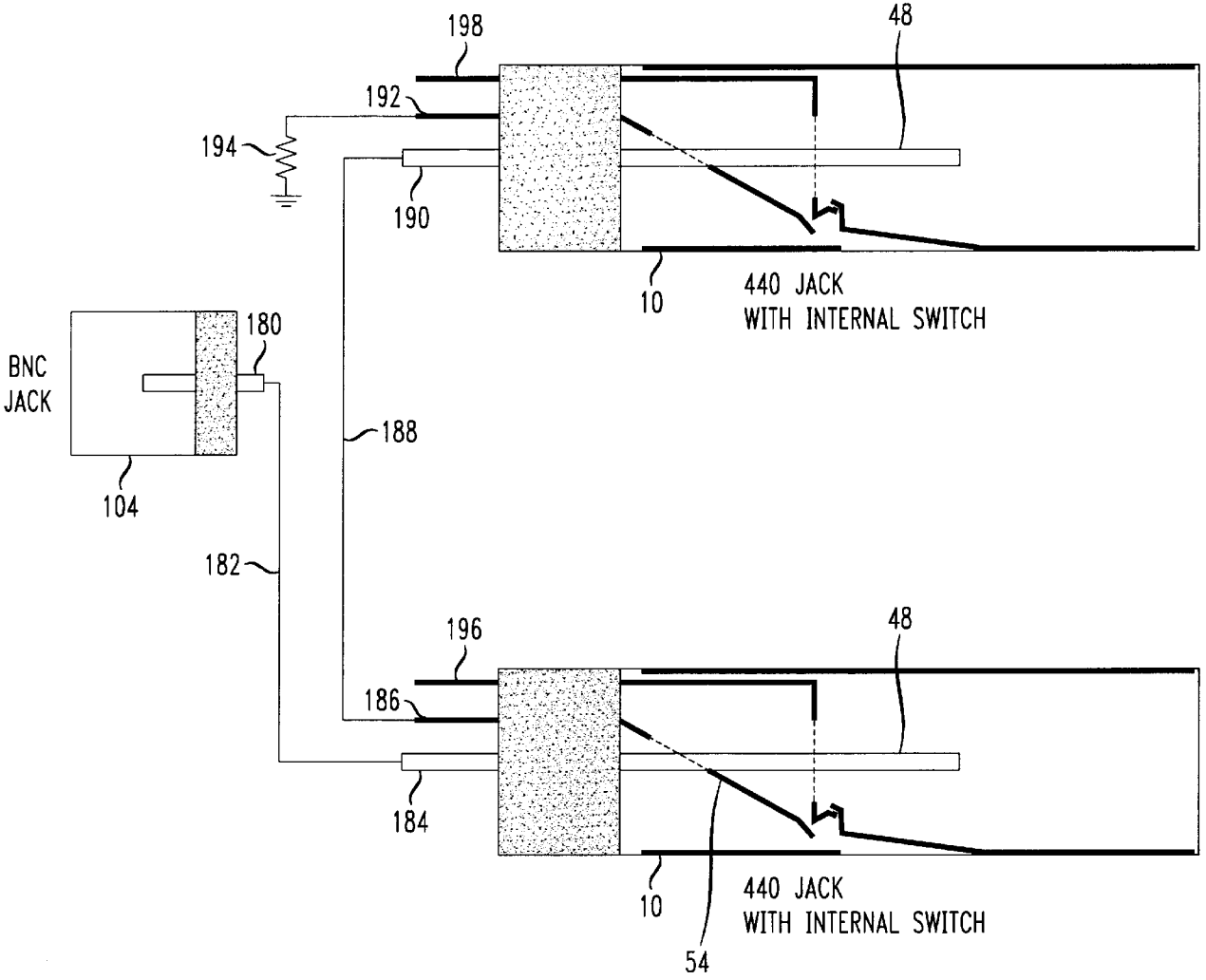
FIG. 6 is a circuit diagram showing coaxial jacks of the invention connected in a 1201A module configuration.

FIG. 6 shows wire connection paths among two of the jacks 10 and one BNC jack 104, in the type 1201A module of FIG. 4. The same connections paths are used between the remaining BNC jack 106 and two other jacks 10. A fifth, remaining jack 10 in FIG. 4 is typically used as a monitoring jack and is coupled to the center conductor of one of the BNC jacks 104, 106 through a sampling resistor to obtain a desired attenuation as is known in the art.

A center conductor terminal 180 of the BNC jack 104 is connected via a printed wire 182 on the board 102, to a center conductor terminal 184 of the lower jack 10 in FIG. 6. A first switch contact terminal 186 on the lower jack 10 in FIG. 6, is connected via a printed wire lead 188 on the board 102 to a center conductor terminal 190 of the upper jack 10 in FIG. 6. A first switch contact terminal 192 on the upper jack 10 is connected to one side of a signal load resistor element 194, and the other side of the resistor element 194 is grounded. Second switch contact terminals 196, 198 of the jacks 10 are left unconnected in the configuration of FIG. 6.

A signal input to the BNC jack 104 is therefore delivered to the center conductor 48 of the lower jack 10. If no mating plug is inserted in the lower jack 10, the input signal is routed to the center conductor 48 of the upper jack 10 via the first switch contact 54 inside the lower jack 10. In the absence of a plug in the upper jack 10, the load resistance element 194 is connected via the first switch contact 54 in the upper jack 10 to the input signal routed to the upper jack's center conductor 48. If a plug of a first cross-connect cable is inserted in the lower jack 10, the input signal from BNC jack 104 is applied only to the first cable's center conductor. If the plug of the first cable is withdrawn from the lower jack 10 and a plug of a second cross-connect cable is inserted in the upper jack 10, then the input signal from BNC jack 104 is applied only to the second cable's center conductor.

While the foregoing description represents a preferred embodiment of the invention, it will be obvious to those skilled in the art that various changes and modifications may be made, without departing from the spirit and scope of the invention as pointed out by the following claims.

What we claim is:

1. A coaxial jack with an internal switch mechanism, comprising:

a cylindrical shell having an axial front opening and defining a plug travel path inside the shell for a mating plug;

an elongate center conductor supported coaxially inside said shell to connect to a corresponding conductor of the plug;

a switch contact support fixed at a back portion of said shell;

an elongate resilient first switch contact fixed at a back end by the switch contact support on one side of the shell axis, wherein the first switch contact extends inside said shell toward the front opening with a predetermined inclination and has a free end positioned on a side of the shell axis opposite said one side;

wherein the first switch contact is configured and positioned to make an electrical connection with the center conductor inside said shell in the absence of an inserted plug; and an elongate actuator supported on the inner periphery of said shell and extending toward the back portion of said shell, wherein the actuator has an engaging part that protrudes into the plug travel path and is configured to cause the free end of the first switch contact to deflect by an amount sufficient to break the electrical connection between the contact and the center conductor when a mating plug travels into the shell and displaces the engaging part of the actuator.

2. A coaxial jack according to claim 1, including an elongate resilient second switch contact fixed at a back end by said switch contact support on said one side of the shell axis, the second switch contact having a ring part that at least partially encircles said center conductor and a hook part joined to said ring part on the side of the shell axis opposite said one side, the hook part being constructed and arranged to engage the engaging part of said actuator.

3. A coaxial jack according to claim 1, wherein the cylindrical shell has a spring constriction along the plug travel path to establish electrical contact with a mating plug body.

4. A coaxial jack according to claim 1, wherein the cylindrical shell forms an axially extending leaf spring along the plug travel path, and said actuator is mounted on said leaf spring.

5. A coaxial jack according to claim 1, wherein said first switch contact is in the form of a generally Y-shaped metallic strip having a fork part at the free end of the contact, and arms extending from the fork part and having back ends that are fixed by said switch contact support.

6. A coaxial jack according to claim 5, wherein said fork part has an inner edge that is urged into electrical contact with the center conductor with a certain preload contact force.

7. A coaxial jack according to claim 5, including an elongate resilient second switch contact fixed at a back end by said switch contact support on said one side of the shell axis, the second switch contact having a ring part that at least partially encircles said center conductor and a hook part joined to said ring part on the side of the shell axis opposite said one side, the hook part being constructed and arranged to engage the engaging part of said actuator, and the fork part of the first switch contact has a contact surface which together with the hook part of the second switch contact define a switch gap in the absence of a displacement of the engaging part of the actuator.

8. A coaxial jack according to claim 7, wherein the hook part of the second switch contact is urged toward the fork part of the first switch contact to establish electrical contact in response to a displacement of the engaging part of the actuator.

9. A coaxial jack module, comprising:

a printed wire board;

a pair of coaxial jacks mounted on said printed wire board, wherein each of said jacks comprises, a cylindrical shell having an axial front opening and defining a plug travel path inside the shell for a mating plug, an elongate center conductor supported coaxially inside said shell to connect to a corresponding conductor of the plug, a switch contact support fixed at a back portion of said shell, an elongate resilient first switch contact fixed at a back end by the switch contact support on one side of the shell axis, wherein the first switch contact extends inside said shell toward the front opening with a predetermined inclination and has a free end positioned on a side of the shell axis opposite said one side, wherein the first switch contact is configured and positioned to make an electrical connection with the center conductor inside said shell in the absence of an inserted plug, and an elongate actuator supported on the inner periphery of said shell and extending toward the back portion of said shell, wherein the actuator has an engaging part that protrudes into the plug travel path and is configured to cause the free end of the first switch contact to deflect by an amount sufficient to break the electrical connection between the contact and the center conductor when a mating plug travels into the shell and displaces the engaging part of the actuator; and a lead printed on said printed wire board that electrically connects the first switch contact of a first one of said jacks with the center conductor of a second one of the jacks.

10. A jack module according to claim 9, including a third jack having at least one terminal mounted on said wire board, and a lead printed on said board that electrically connects a terminal of the third jack to the center conductor of the first one of said pair of jacks.

11. A jack module according to claim 9, including a load resistor mounted on said wire board, and a lead printed on said board that electrically connects a terminal of the resistor to the first switch contact of the second one of said pair of jacks.

* * * * *